US007001484B2

(12) United States Patent
Ni et al.

(10) Patent No.: US 7,001,484 B2
(45) Date of Patent: Feb. 21, 2006

(54) PEROXIDE BLEACHING OF WOOD PULP USING STABILIZERS AND SODIUM HYDROSULFIDE REDUCING AGENT

(75) Inventors: Yonghao Ni, Fredericton (CA); Zhiqing Li, Fredericton (CA)

(73) Assignee: University of New Brunswick, Fredericton (CA)

( * ) Notice: Subject to any disclaimer, the term of this patent is extended or adjusted under 35 U.S.C. 154(b) by 0 days.

(21) Appl. No.: 10/251,888

(22) Filed: Sep. 23, 2002

(65) Prior Publication Data

US 2003/0070777 A1 Apr. 17, 2003

Related U.S. Application Data

(63) Continuation-in-part of application No. 09/564,853, filed on May 4, 2000, now abandoned.

(51) Int. Cl.
*D23C 9/16* (2006.01)

(52) U.S. Cl. ..... 162/76; 162/78; 162/82; 162/83; 162/84; 162/86

(58) Field of Classification Search ..... 162/76, 162/78, 82, 84, 86, 83, 90
See application file for complete search history.

(56) References Cited

U.S. PATENT DOCUMENTS

| | | | | |
|---|---|---|---|---|
| 2,872,280 A | | 2/1959 | Kindron | |
| 2,920,011 A | | 1/1960 | Eilers, Jr. | |
| 3,023,140 A | | 2/1962 | Textor | |
| 4,029,543 A | * | 6/1977 | Lindahl | 162/24 |
| 4,311,553 A | | 1/1982 | Akerlund et al. | |
| 4,599,138 A | | 7/1986 | Lindahl | |
| 4,731,161 A | | 3/1988 | Ehrhardt | |
| 4,812,206 A | | 3/1989 | Devic et al. | |
| 4,849,053 A | | 7/1989 | Gentile, Jr. et al. | |
| 4,915,785 A | | 4/1990 | Siminoski et al. | |
| 4,938,842 A | | 7/1990 | Whiting et al. | |
| 5,002,635 A | | 3/1991 | Gentile, Jr. et al. | |
| 5,118,389 A | | 6/1992 | Dubelsten et al. | |

FOREIGN PATENT DOCUMENTS

| | | |
|---|---|---|
| AU | 606930 | 2/1991 |
| CA | 686115 | 5/1964 |
| CA | 820190 | 8/1969 |
| CA | 1262805 | 11/1989 |
| CA | 1274655 | 10/1990 |
| CA | 2041388 | 10/1991 |
| CA | 1294655 | 1/1992 |
| CA | 2057231 | 7/1992 |
| CA | 2099881 | 7/1992 |

(Continued)

OTHER PUBLICATIONS

Presley, J.R., et al., "Pulp Bleaching: Principles and Practice," Edited by C.W. Dence and D.W. Reeve, pp. 480-481.

(Continued)

*Primary Examiner*—Steve Alvo
(74) *Attorney, Agent, or Firm*—Morgan, Lewis & Bockius LLP

(57) ABSTRACT

A process for peroxide bleaching of mechanical or high yield pulp, the process comprising adding to a pulp slurry at least one stabilizer for stabilizing low valency states of transition metal ions in the slurry; subsequently adding caustic soda to said slurry simultaneously with or subsequent to adding said at least one stabilizer; adding hydrogen peroxide to the slurry at a preselected point; and subjecting the slurry to preselected conditions to complete the bleaching process.

1 Claim, 1 Drawing Sheet

FOREIGN PATENT DOCUMENTS

| | | |
|---|---|---|
| CA | 1310797 | 12/1992 |
| CA | 2070556 | 12/1992 |
| CA | 2099827 | 1/1994 |
| CA | 2189796 | 11/1995 |
| CA | 2017807 | 12/1995 |
| JP | 52-063402 | 5/1977 |
| JP | 1735463 | 5/1992 |

OTHER PUBLICATIONS

Ni, Y., et al., "Improving Peroxide Bleacing of Mechanical Pulps by An Enhanced Chelation Process," Proceedings, PAPTAC Annual Meeting, Montreal, 1999, pp. 1-5.

* cited by examiner

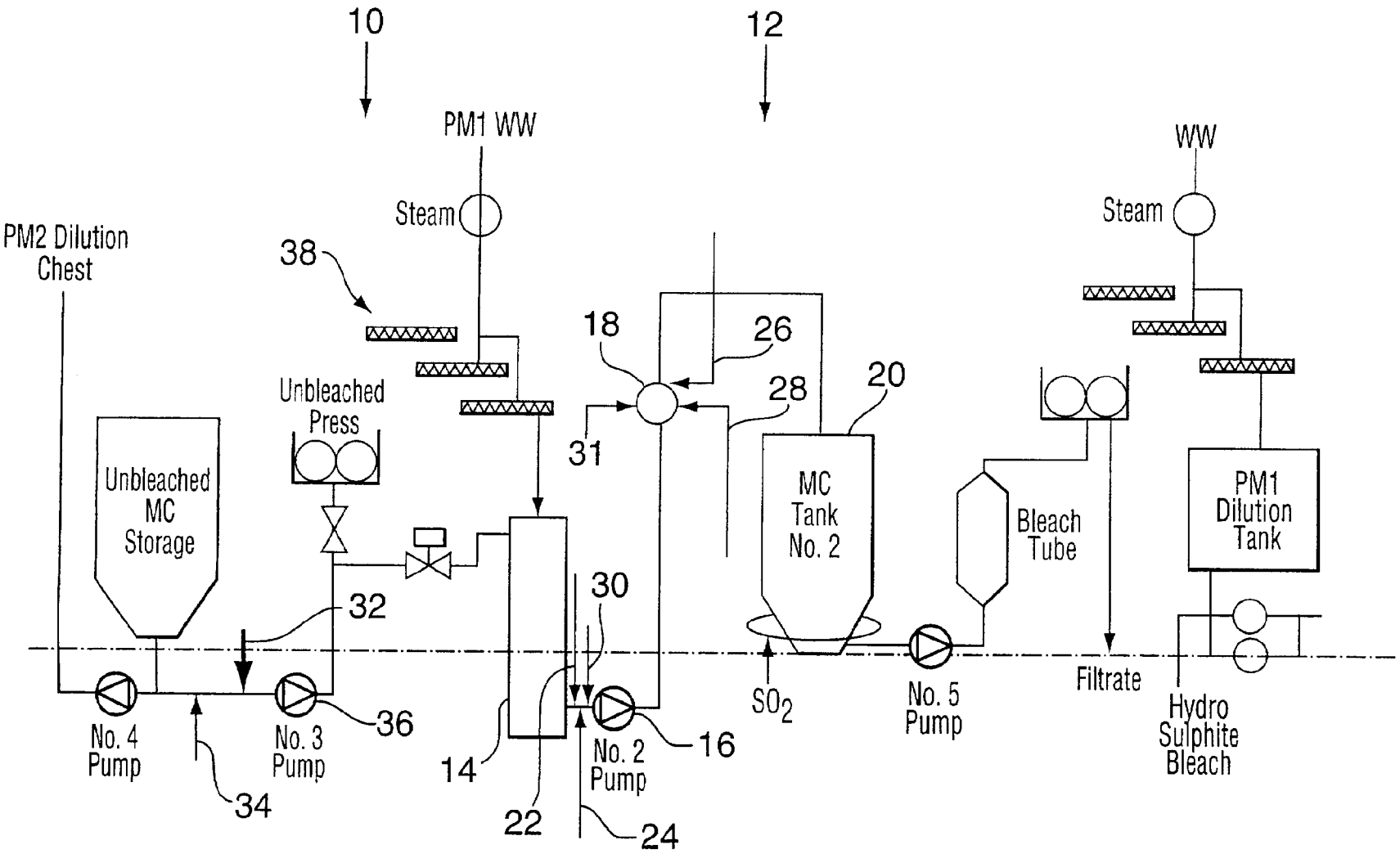
WW
Steam
PM1 Dilution Tank
Hydro Sulphite Bleach
Filtrate
Bleach Tube
No. 5 Pump
20
MC Tank No. 2
$SO_2$
12
26
28
16
No. 2 Pump
24
18
31
30
22
14
PM1 WW
Steam
10
38
Unbleached Press
32
36
No. 3 Pump
34
Unbleached MC Storage
No. 4 Pump
PM2 Dilution Chest

PEROXIDE BLEACHING OF WOOD PULP USING STABILIZERS AND SODIUM HYDROSULFIDE REDUCING AGENT

This is a Continuation-In-Part of U.S. patent application Ser. No. 09/564,853 filed May 4, 2000, and now abandoned.

FIELD OF THE INVENTION

This invention relates to an improved hydrogen peroxide bleaching process for mechanical or high yield pulps.

BACKGROUND OF THE INVENTION

There is continuous research in the pulp and paper industry aimed at improving efficiencies in the various aspects of pulp and paper processes. The bleaching process is one aspect which has received ongoing attention.

The present invention is concerned with improvements in the process for improving brightness in mechanical and ultra-high yield pulps, such as groundwood pulp (GW), thermomechanical pulp (TMP), chemithermomechanical pulp (CTMP), and alkaline peroxide mechanical pulp (APMP). The processes of interest accomplish the bleaching utilizing hydrogen peroxide in an alkaline environment.

The efficiency of such processes depends on various factors, a very important one of which is the full utilization of the hydrogen peroxide. The objective is to obtain the dual efficiency of the improved brightness and reduced chemical usage that comes from increased utilization.

It is known that chemicals present in the pulp slurry will result in decomposition of a part of the hydrogen peroxide. This is particularly the case in the presence of transition metal ions. The hydrogen peroxide decomposition obviously reduces potential bleaching power, but also affects brightness by causing the formation of new chromophores. Manganese is known to be the most harmful transition metal species in this regard.

It is common to utilize stabilizers and sequestering agents to reduce the peroxide decomposition.

Notwithstanding the use of these methods, the peroxide decomposition has been an ongoing problem.

Against this background the present invention provides a process in which the peroxide decomposition is reduced and brightness enhanced relative to known processes. This process is carried out in the context of conventional peroxide bleaching processes.

PRIOR ART

Typical state of the art processes are described in the following references:

1. Presley, J. R. and Hill, R. T., Pulp Bleaching: Principles and Practice, Edited by C. W. Dence and D. W. Reeve, Page 480. This is the so-called cascade system for preparation of bleach liquor, in which magnesium sulfate and sodium silicate are added to water and intimately mixed, followed by the addition of caustic soda and finally by the addition of hydrogen peroxide. The resulting liquor is subsequently mixed with pulp.
2. Presley, J. R. and Hill, R. T., Pulp Bleaching: Principles and Practice, Edited by C. W. Dence and D. W. Reeve, Page 481. This is the so-called in-line system, where similar mixing and addition occurs but without the cascade arrangement.
3. Ni, Y. et al., Proceedings, PAPTAC Annual Meeting, Montreal, 1999, Page B183. This process provides a sequential addition of chemicals beginning with the addition of hydrogen peroxide to a pulp slurry and the subsequent and simultaneous addition of caustic soda and silicate stabilizer.
4. Vincent, A. H. D. et al, Magnesium Oxide Driven Peroxide Bleaching, An economical and Environmentally Viable Process, APPITA Annual Conference 1997. This paper describes the use of magnesium oxide as an alkaline source in peroxide bleaching.
5. Soteland, N., et. al., Use of MgO or CaO As The Only Alkaline Source In Peroxide Bleaching of High Yield Pulps, pp. 231–236, 1988 International Pulp Bleaching Conference, TAPPI Proceedings.
6. Griffiths, Paul, et. al., Magnesium Oxide as a Base for Peroxide Bleaching of Radiata Pine TMP, pp. 50–54, Appita Vol. 47 No. 1, January 1994.

The following patents and published applications deal with bleaching processes for mechanical or high yield pulp, but do not address the process of the present invention:

Canadian Patents 686,115; 820,190; 1,294,655; 1,310,797; 2,041,588; 2,070,556; Canadian published Application 2,278,399;

U.S. Pat. Nos. 2,872,280; 3,023,140; 4,029,543; 4,731,161; 4,812,206; 4,915,785; 4,938,842; 5,118,389; U.S. published Application US 2001/0050153 A1;

Japanese Patent document 52-63402; and

Russian Patent document 1735463.

BRIEF SUMMARY OF THE INVENTION

It has now been determined that improvement in the bleaching process can be obtained if at least one stabilizer is added to the pulp slurry prior to the addition of the hydrogen peroxide, and the process is carried out subject to a specified pH limitation.

Thus, the invention provides a process for peroxide bleaching of mechanical or high yield pulp, the process comprising adding to a pulp slurry at least one stabilizer for stabilizing transition metal ions in said slurry; subsequently adding hydrogen peroxide to said slurry at a preselected point; adding an alkali source to said slurry simultaneously with or subsequent to adding said at least one stabilizer, such that the pH of the resulting slurry does not exceed 11.5; and subjecting said slurry to preselected conditions to complete said bleaching process. The stabilizer is chosen from the group consisting of silicate, $MgSO_4$ or other stabilizers. Other stabilizers may include DTPA or other sequestering agents or other stabilizers.

In a further embodiment, the process comprises the pretreatment steps of adding a chelating agent to said slurry and subsequently removing chelated transition metal ions from said slurry.

In a further embodiment, the process further comprises the pretreatment steps of adding a chelating agent and a reducing agent to said slurry and subsequently removing chelated transition metal ions from said slurry In a further embodiment there is provided a process for peroxide bleaching of mechanical or high yield pulp, the process comprising adding to a pulp slurry sodium hydrosulfite and DTPA; subsequently removing from the slurry chelated transition metal ions; adding to the slurry a stabilizer comprising sodium silicate and/or other stabilizer; subsequently adding hydrogen peroxide to said slurry at a preselected point in said process; adding an alkaline source to said slurry simultaneously with or subsequent to adding said at least one stabilizer, such that the pH of the slurry does not exceed 11.5; and subjecting said slurry to preselected conditions to complete said bleaching process.

BRIEF DESCRIPTION OF THE DRAWINGS

The FIGURE illustrates in schematic form a process according to the invention. While the invention will be described in conjunction with the illustrated embodiments, it will be understood that it is not intended to limit the invention to such embodiments. On the contrary, it is intended to cover all alternatives, modifications and equivalents as may be included within the spirit and scope of the invention as defined by the appended claims.

DETAILED DESCRIPTION OF THE PREFERRED EMBODIMENTS

In the following description, similar features in the drawings have been given similar reference numerals.

It is useful in understanding the invention to consider the problem that arises in the peroxide bleaching process as a result of the naturally occurring transition metal ions in the wood. The particular transition metals present and their concentrations vary geographically and seasonally, but the problem caused by the transition metals will always be present.

As a fundamental part of process efficiency, there is a desire to maximize peroxide utilization in the bleaching process. At the same time, it is desired to minimize the production of chemicals in the process which adversely affect brightness by producing chromophores.

The invention therefore concerns the realization that if the transition metal ions can be stabilized by the addition of stabilizers, such as silicate, to a pulp slurry prior to addition of hydrogen peroxide, the decomposition of peroxide will be greatly reduced and the overall efficiency of the process will be raised. It is advantageous to accomplish this in the context of the conventional peroxide bleaching process, so that the parameters of that process utilized in a given mill need not be altered to any great extent.

As will be discussed below, one preferred embodiment of the invention involves a pre-treatment process to remove some transition metal ions. This comprises an enhanced chelation process preceding the bleaching process itself.

Turning now to the drawing, the flow sheet can be divided as between the pre-treatment section 10 and the bleach section 12. The process of the present invention is not dependent on the presence of a pre-treatment section 10 and can be said to begin at the tank 14. From tank 14 the unbleached pulp slurry is pumped via pump 16 through T-mixer 18 to tank 20. The stabilizers and bleach chemicals are added between tanks 14 and 20. It is convenient to add stabilizers via lines 22 and 24 at pump 16 to facilitate mixing at pump 16. Alkali can also be added via line 30 at pump 16 or farther downstream, via, for example, line 31 at mixer 18. Hydrogen peroxide and water are subsequently added through lines 26 and 28 to T-mixer 18.

Sodium silicate is the preferred stabilizer, it may be combined with a small amount of magnesium sulfate, or DTPA or EDTA or their salts.

The alkali source can be chosen from those used in conventional such processes including soda ash, magnesium oxide, magnesium hydroxide and NaOH.

It is highly preferable that the inventive process described above be preceded by a pre-treatment process, as is common in the art, for the removal of a significant proportion of the transition metal ions which are present in varying concentrations in the pulp.

It is further preferred that the pre-treatment process comprise a reducing agent assisted chelation process. One such process is described in Ni, Y. et. al., Pulp & Paper Canada, 100(10), 51–55 (1999).

Therefore, with reference to the drawing, the pre-treatment process comprises adding at least one of a chelating agent at line 32 and preferably a reducing agent at line 34. In the preferred case both the chelating agent and the reducing agent are used in the pretreatment process.

While known suitable chelating and reducing agents may be used in the pre-treatment process, it is preferred that the chelating agent be DTPA and that the reducing agent be sodium hydrosulfite.

An advantage of these two additives is that conditions for their use are similar, so that they can be added in a single step.

Subsequent to the addition of the additives, preferably downstream of a pump 36, the pulp slurry is dewatered and washed at press and washers 38 to remove the chelated transition metal ions. The slurry is then transferred into tank 14 and hence into the bleach process.

With reference to the bleach process, the following are typical parameters, where the alkali source is caustic soda:

Hydrogen peroxide charge 1–10%
Caustic soda charge 0.5–5%
Sodium silicate charge 1–5%
Magnesium sulfate charge 0–0.1%
DTPA charge 0.05–0.5%

The following examples illustrate the invention.

EXAMPLE 1

Equivalent to 10 grams o.d. mill chelated TMP pulp from a mill in Eastern Canada (60 ppm Mn, 53% ISO initial brightness) was treated in a polyethylene bag with 2% $Na_2SiO_3$, reagent grade, and 0.05% $MgSO_4$ for 1 minute; and then with addition of 3% $H_2O_2$ for about 5 minutes. A thorough mixing was provided after each reagent addition. Subsequently 1.5% NaOH was added to the pulp in the polyethylene bag. The bag, along with its contents, was placed in a temperature bath at 60* C. The bleaching conditions were 120 min, 12% pulp consistency.

After the completion of the required reaction time, a portion of the filtrate was then taken to determine the residual $H_2O_2$ and ending pH. The remaining pulp slurry was transferred from the bag to a beaker, further diluted, and neutralized with sulfuric acid to pH 5. The neutralized pulp slurry was subsequently filtered and washed thoroughly with deionized water. A handsheet was then made following TAPPI test method T272, air-dried and determined for brightness.

The residual hydrogen peroxide was 0.65% on pulp, and the brightness of the resulting pulp was 69.6% ISO.

The process described above is designated as the $P_M$ process.

EXAMPLE 2

The following is provided to illustrate that the residual hydrogen peroxide is much less and the brightness of the resulting pulp is lower if the same TMP pulp was subjected to a conventional peroxide stage (P) under otherwise the same conditions.

The conventional peroxide stage (designated as P process in the subsequent discussion) was performed as follows:

Equivalent to 0.05% $MgSO_4$, 2.0% $Na_2SiO_3$, 1.5% NaOH, and 3.0% $H_2O_2$ were first added in that order to a beaker containing distilled water to form a mixture. This mixture was then added to a polyethylene bag which contains equivalent to 10 grams o.d. of the same TMP pulp as in Example 1. The contents were mixed thoroughly. Subsequently, the polyethylene bag, along with its contents, was placed in a temperature bath at 60* C. to start bleaching. The bleaching conditions were the same as those in Example 1. After the completion of the required reaction time, samples were collected for residual $H_2O_2$, ending pH and brightness, in accordance with the procedures in Example 1.

The residual hydrogen peroxide was 0.29% on pulp and the pulp brightness was 68.7% ISO. These results are compared with those in Example 1 of 0.65% and 69.6% ISO, respectively, supporting that the peroxide bleaching performance is improved by the process outlined in Example 1.

EXAMPLE 3

In this example, it will be shown that the $P_M$ process, described in Example 1, can be varied and the improvement in bleaching performance over the P process can be maintained, even enhanced. In this case, DTPA was added as part of the stabilizers, along with sodium silicate and magnesium sulfate. These stabilizers were mixed with the pulp slurry for 5 minutes. Subsequently, the required amount of caustic soda was added. The same TMP pulp as that in Example 1 was used. The procedures for the $P_M$ and P process were the same as those in Example 1, except that 0. 1% DTPA solution was added to the pulp slurry in a polyethylene bag, along with 2% $Na_2SiO_3$ and 0.05% $MgSO_4$.

The residual hydrogen peroxide was 0.87% on pulp, and the brightness of the resulting pulp is 70.8% ISO. Evidently, in comparison with Example 2, the $P_M$ process given in this example leads to much improved bleaching results.

EXAMPLE 4

In this example, it will be shown that the $P_M$ process, described in Example 1, can be further varied, and the improvement in bleaching performance over the P process can be maintained. In this case, the stabilizers, namely sodium silicate, magnesium sulfate, DTPA and other chemicals, needed for peroxide bleaching, namely, caustic soda and hydrogen peroxide, are added to the pulp slurry in various orders. Three more orders were conducted, namely:

A:

$1^{st}$ Sodium silicate and magnesium sulfate
$2^{nd}$ Caustic soda
$3^{rd}$ DTPA
$4^{th}$ $H_2O_2$

B:

$1^{st}$ Sodium silicate and magnesium sulfate
$2^{nd}$ Caustic soda
$3^{rd}$ $H_2O_2$
$4^{th}$ DTPA

C:

$1^{st}$ DTPA
$2^{nd}$ Sodium silicate and magnesium sulfate
$3^{rd}$ Caustic soda
$4^{th}$ $H_2O_2$ Always a thorough mixing is provided before the next chemical is charged to the pulp. The key here, however, is that at least one of stabilizers, such as sodium silicate and DTPA, is charged to the pulp with sufficient mixing before the addition of hydrogen peroxide.

The same TMP pulp as that in Example 1 was used. The chemical charges and other procedures were the same as those in Example 1. The results are listed in Table 1.

TABLE 1

| | Sequence A | Sequence B | Sequence C |
|---|---|---|---|
| Brightness (% ISO) | 70.7 | 70.7 | 70.8 |
| Residual $H_2O_2$ (% on pulp) | 1.01 | 0.89 | 0.95 |

In comparison with the P process, Example 2, one can conclude that the bleaching performances of Sequences A, B, and C are much better.

EXAMPLE 5

In this example it will be shown that the benefit of the $P_M$ process, in comparison with the P process, can still be achieved when applied to a TMP pulp, which was chelated in the $Q_y$ process, the so-called sodium hydrosulfite assisted chelation process.

Equivalent to 20 grams o.d. TMP pulp (brightness 54.3% ISO, 149 ppm Mn) was treated in a polyethylene bag with 0.2% DTPA (as active DTPA on pulp) and 0.1% sodium hydrosulfite (on pulp) under the conditions of 3% pulp consistency, 60* C. and 10 minutes. After the completion of the required time the pulp slurry was filtered and pressed to about 30% pulp consistency. The chelated pulp has a residual manganese content of about 34 ppm, which is then ready for the bleaching experiments.

One half of the $Q_y$ treated pulp was then treated in a polyethylene bag with 3% sodium silicate, 0.05% $MgSO_4$ for about 10 minutes. Subsequently, 2% $H_2O_2$ and 1.6% caustic soda were added to the pulp slurry in that order. A thorough mixing was provided before the addition of each chemical. The other bleaching conditions and procedures were the same as those in Example 1.

The residual hydrogen peroxide was 0.25% (on pulp) and the brightness of the resulting pulp was 69.0% ISO.

The other half of the $Q_y$ treated pulp was subjected to a conventional peroxide stage following the same procedure as those in Example 2 except that the chemical charges were the same as those in the previous paragraph, i.e. 3% $Na_2SiO_3$, 0.05% $MgSO_4$, 1.6% NaOH and 2% $H_2O_2$. The residual $H_2O_2$ was 0.05% (on pulp) and the brightness of the resulting pulp was 65.8% ISO.

EXAMPLE 6

It will be shown that $P_M$ process, described in Example 1, can be further varied and the improvement in bleaching performance over the P process can be maintained. In this case, instead of reagent grade, a silicate solution (37.56% solid, 8.90% $Na_2O$, 28.66% $SiO_2$, specific gravity @ 20° C., 1.394, viscosity @ 20° C., 177 cP), which is commercially available was used. The stabilizers, namely the silicate solution, and/or $MgSO_4$, were mixed with the required NaOH. The above mixture was then added to the pulp.

A TMP pulp with initial brightness of 57.8% ISO and 48 ppm Mn content was used. Equivalent to 10 grams o.d. of above pulp at a consistency of about 15%, was added to a polyethylene bag. A mixture prepared with 4% of the above specified silicate solution (on o.d. pulp), 0.1% $MgSO_4$ (on o.d. pulp) and 2.8% NaOH (on o.d. pulp), was then admitted to the same polyethylene bag and thoroughly mixed with the pulp fibres (the mixing time was about 1 min). Subsequently, 3.5% $H_2O_2$ was added to the bag and mixed thoroughly with its contents. The bag, along with its content, was placed in a temperature bath at 70° C. The bleaching conditions were: 120 min, 12% pulp consistency. After the completion of the required reaction, samples were collected for residual $H_2O_2$, ending pH and brightness, in accordance with the procedures in Example 1. The residual hydrogen peroxide was 1.28% and the pulp brightness was 72.5% ISO.

The same mill chelated TMP pulp, initial brightness of 57.8% ISO and 48 ppm Mn content was subjected to a conventional peroxide stage (P) with the same chemical charges as above (0.1% $MgSO_4$, 4% silicate solution, 2.8% NaOH, 3.5% $H_2O_2$, all based on o.d. pulp) under the same conditions (70° C., 12% pulp consistency). The above chemicals were added to a beaker containing distilled water to form a mixture. The mixture was then added to a polyethylene bag which contains equivalent to 10 grams o.d. pulp. The subsequent procedures were the same as those in Example 2.

The residual hydrogen peroxide was 0.28% and the pulp brightness was 70.7%. The results are compared with above of 1.28% and the pulp brightness of 72.5% ISO respectively, supporting that the peroxide bleaching performance is improved by the $P_M$ process.

EXAMPLE 7

A TMP pulp (initial brightness of 50.4% ISO), directly obtained from a 3-stage refiner process, was first subjected to a laboratory chelation process, which was performed under the conditions of 0.125% DTPA, 10% pulp consistency, 50* C. and 30 min. Then the pulp slurry was filtered and pressed to 25% pulp consistency, and used for subsequent peroxide bleaching.

In the $P_M$ process, the above pressed pulp was diluted to about 12% pulp consistency in a polyethylene bag with deionized water. The bag along with its content was pre-heated to 60* C. Subsequently, 3.0% industrial silicates, 0.05% $MgSO_4$ and 1.0% NaOH were added to the bag. A thorough mixing was provided (its pH was 10.7). After about 1 min, 1.5% $H_2O_2$ was added to the pulp slurry in the bag (the pH was 10.2). The bleaching was allowed at 60* C. for 2 hours at 10% pulp consistency. The subsequent procedures were the same as those in Example 1. The residual peroxide was 0.24%, the final pH was 7.5 and the brightness of the resulting pulp was 63.1% ISO.

Control

In the control run, the same pressed pulp (25% pulp consistency) was diluted to about 12% pulp consistency and pre-heated to 60* C. Subsequently, 3.0% industrial silicates, 0.05% $MgSO_4$, 1.0% NaOH and 1.5% $H_2O_2$ was mixed in a beaker, and then the mixture was transferred to the heated pulp slurry, which was in a polyethylene bag (the pH was 10.3). The bleaching conditions and the subsequent procedure were the same as above. The residual peroxide was 0.04%, the final pH was 7.6 and the brightness of the resulting pulp was 61.7% ISO.

It is evident that the $P_M$ process has higher pulp brightness and higher residual peroxide, in comparison with the control.

EXAMPLE 8

A mill chelated SGW (initial brightness of 63.1% ISO) was used for the comparison of the $P_M$ process and the conventional peroxide process.

In the $P_M$ process, 1.5% NaOH, 3.9% industrial silicates were mixed with pulp slurry at about 12% pulp consistency and 60* C. (the pH was 11.0). After about 1 min., 1.9% $H_2O_2$ was added (the pH was 10.4). The bleaching was carried out at a 10% pulp consistency, 60* C. for 70 min. The subsequent procedures were the same as those in Example 1. The residual peroxide was 0.74%, the end pH was 8.7 and the brightness of the resulting pulp was 73.9% ISO.

Control

In the control, 3.9% industrial silicates, 1.5% NaOH and 1.9% $H_2O_2$ were mixed in a beaker first, the mixture was then added to the pulp slurry at about 12% pulp consistency and 60* C. (the pH was 10.7). The bleaching conditions and subsequent procedures were the same as the $P_M$ process. The residual peroxide was 0.35%, the end pH was 8.7 and the brightness of the resulting pulp was 73.0% ISO.

Again, the above results support the conclusion that the performance of the $P_M$ process is superior to that of the control.

EXAMPLE 9

The same SGW pulp was subjected to peroxide bleaching under the $P_M$ and conventional peroxide process at higher peroxide charge (3.9%) and sodium hydroxide charge (2.0%). Other conditions and procedures were kept the same. The results are listed in the following table. Once again, the $P_M$ process produces bleached pulps with higher brightness, yet at a lower peroxide consumption.

| | Control, the P Process | The $P_M$ Process |
|---|---|---|
| pH after the addition of NaOH and silicates | Not applicable | 11.3 |
| pH after the addition of $H_2O_2$ | Not applicable | 10.5 |
| pH after the addition of mixture of silicates, NaOH and $H_2O_2$ | 10.6 | Not applicable |
| End pH | 8.7 | 8.7 |
| Residual $H_2O_2$ (%) | 0.90 | 1.75 |
| Brightness (% ISO) | 76.5 | 77.3 |

EXAMPLE 10

A mill chelated pulp with initial brightness of 55% ISO was used. In the $P_M$ process, 1.2% industrial silicates, 0.08% $MgSO_4$ and 1.0% NaOH were added to the pre-heated pulp at 20% pulp consistency and 80* C. (the pH was 11.0). After about 1 min, additional 1% NaOH (the total NaOH charge was 2%) and 2% $H_2O_2$ were added to the pulp (the pH was 11.0). The bleaching was carried out at 18% pulp consistency, 80* C. and 2.5 hours. The subsequent procedures were the same as those in Example 1. The residual peroxide was 0.32%, the end pH was 7.9 and the brightness of the resulting pulp was 75.6% ISO.

Control

In the control, 1.2% industrial silicates, 0.08% $MgSO_4$, 2% NaOH and 2% $H_2O_2$ were mixed in a beaker. The mixture was then added to the pre-heated pulp at 20% pulp consistency and 80* C. (the pH was 10.9). The bleaching conditions and the subsequent procedures were the same as above. The residual peroxide was 0.19%, the end pH was 7.8 and the brightness of the resulting pulps was 74.7% ISO. The above example again shows that a higher brightness is achieved for the $P_M$ process than the control under otherwise the same conditions.

EXAMPLE 11

Another CTMP Maple pulp with initial brightness of 54% was used. Here, $Mg(OH)_2$, instead of NaOH, was the alkali source. Also, no silicates were added, and DTPA was used as the peroxide stabilizer. In the $P_M$ process, 1% $Mg(OH)_2$ slurry and 0.1% DTPA were added to the pre-heated pulp at 20% pulp consistency and 80* C. (the pH was 8.12). After about 1 min, 2% $H_2O_2$ was added to the pulp (the pH was 7.8). The bleaching conditions were 17% pulp consistency, 80* C., 2.5 hours. The subsequent procedures were the same as those in Example 1. The residual peroxide was 0.66%, end pH was 6.9 and the brightness of the resulting pulp was 70.1% ISO.

Control

In the control process 0.1% DTPA, 1% $Mg(OH)_2$ slurry and 2% $H_2O_2$ were added to the pre-heated pulp at 20% pulp consistency and 80* C. (the pH was 7.9). The bleaching conditions and subsequent procedures were the same as those above. The residual peroxide was 0.58%, the end pH was 7.2 and the brightness of resulting pulps was 69.4%. The above results show that the benefit of the $P_M$ process is still apparent even $Mg(OH)_2$ instead of NaOH, was used as the alkali source during peroxide bleaching.

The initial pH in this series of Examples (7 to 11) did not exceed 11.0 for conventional peroxide bleaching conditions. A fairly extreme example went to 11.3, and it is contemplated that the initial pH would never exceed 11.5.

Furthermore, the pH at the end of the bleaching process was not more than about 8.7. This would normally not exceed 9.0 and, in an extreme case, should not exceed 9.5.

EXAMPLE 12

A Stoneground wood pulp (SGW) with an initial brightness of 57.6% ISO was used.

In the $P_M$ process, 1% $Mg(OH)_2$ and 0.3% DTPA were mixed with the pulp first. After 30 seconds to 1 min, 2.73% of hydrogen peroxide was then added to the pulp.

In the P process, the bleach liquor consisting of 1% $Mg(OH)_2$, 0.3% DTPA and 2.73% $H_2O_2$ was prepared first in a beaker. This mixture was then added to the pulp.

The bleaching conditions of the P and $P_M$ processes were the same: 7.5% pulp consistency, 240 min. 75° C. The results are given in Table 1.

One can find that the $P_M$ process produced the pulp with a higher brightness (73.0 versus 71.2% ISO) at a higher residual peroxide (1.3 versus 1.0%) than the P process.

TABLE 1

| Description | Brightness (% ISO) | Residual $H_2O_2$ (%) |
|---|---|---|
| P | 71.2 | 1.0 |
| $P_M$ | 73.0 | 1.3 |

EXAMPLE 13

Another SGW pulp with an initial brightness of 62.9% ISO was tested, and a comparison is made between the P and $P_M$ processes of the magnesium hydroxide based peroxide process.

In the $P_M$ process, 1.5% $Na_2SiO_3$ and 1% $Mg(OH)_2$ were mixed with the pulp first. After 1 min, 3.4% hydrogen peroxide was then added to the pulp.

In the P process, the bleach liquor, consisting of 1.5% $Na_2SiO_3$, 1% $Mg(OH)_2$ and 3.4% $H_2O_2$ was prepared first in a beaker. This mixture was then added to the pulp.

The bleaching conditions of the P and $P_M$ processes were the same: 25% pulp consistency, 52° C., 150 min. The results are given in Table 2.

TABLE 2

| Description | Brightness (% ISO) | Residual $H_2O_2$ (%) |
|---|---|---|
| P | 80.6 | 1.9 |
| $P_M$ | 81.6 | 2.1 |

Again Table 2 shows that, in comparison with the P process, the $P_M$ process produces much better bleaching results.

Thus, it is apparent that there has been provided in accordance with the invention a peroxide bleaching of wood pulp that fully satisfies the objects, aims and advantages set forth above. While the invention has been described in conjunction with specific embodiments thereof, it is evident that many alternatives, modifications and variations will be apparent to those skilled in the art in light of the foregoing description. Accordingly, it is intended to embrace all such alternatives, modifications and variations as fall within the spirit and broad scope of the invention.

What we claimed is:

1. A process for peroxide bleaching of mechanical or high yield pulp, said process consisting of:

adding to a pulp slurry DTPA as a stabilizer for chelating transition metal ions and sodium hydrosulfite as a reducing agent;

subsequently removing from said slurry the resulting chelated transition metal ions;

adding to said slurry, after removing said chelated transition metal ions, (a) sodium silicate and 0 to 0.1% $MgSO_4$ by weight on dry pulp as stabilizers, and (b) optionally at least one chelating agent selected from DTPA and EDTA;

subsequently adding hydrogen peroxide to said slurry at a preselected point in said process;

adding caustic soda to said slurry simultaneously with or subsequent to adding said stabilizers and said optionally at least one chelating agent, such that the pH of the resulting slurry does not at any point exceed 11.5; and subjecting said slurry to preselected conditions to complete said process for peroxide bleaching.

* * * * *

UNITED STATES PATENT AND TRADEMARK OFFICE

CERTIFICATE OF CORRECTION

PATENT NO. : 7,001,484 B2
APPLICATION NO. : 10/251888
DATED : February 21, 2006
INVENTOR(S) : Yonghao Ni et al.

It is certified that error appears in the above-identified patent and that said Letters Patent is hereby corrected as shown below:

Title Page, Item (54), the title should read: --Peroxide Bleaching of Wood Pulp Using Stabilizers and Sodium Hydrosulfite Reducing Agent--.

Signed and Sealed this

Third Day of April, 2007

JON W. DUDAS
*Director of the United States Patent and Trademark Office*